US005753589A

United States Patent [19]

Takao et al.

[11] Patent Number: 5,753,589

[45] Date of Patent: May 19, 1998

[54] THERMAL TRANSFER IMAGE-RECEIVING SHEET

[75] Inventors: Shino Takao; Hitoshi Saito, both of Tokyo-to, Japan

[73] Assignee: Dai Nippon Printing Co., Ltd., Japan

[21] Appl. No.: 521,984

[22] Filed: Aug. 31, 1995

[30] Foreign Application Priority Data

Aug. 31, 1994 [JP] Japan ..... 6-230643

[51] Int. Cl.[6] ..... B41M 5/035; B41M 5/38

[52] U.S. Cl. ..... 503/227; 428/195; 428/520; 428/690; 428/913; 428/914

[58] Field of Search ..... 8/471; 428/195, 428/690, 913, 914, 423.1, 480, 500, 520, 522; 503/227

[56] References Cited

U.S. PATENT DOCUMENTS 5,242,887 9/1993 Usui ..... 503/227

FOREIGN PATENT DOCUMENTS 0 328 144 8/1989 European Pat. Off. ..... 503/227
0 516 370 12/1992 European Pat. Off. ..... 503/227

OTHER PUBLICATIONS

Database WPI, Section CH, Week 8825, Derwent Publications Ltd., London, GB; Class A89, AN 88–171092 & JP–A–63–108 338 (Konishiroku Photo KK) 5/13/88 & Abstract.

*Primary Examiner*—Bruce H. Hess
*Attorney, Agent, or Firm*—Parkhurst & Wendel, L.L.P

[57] ABSTRACT

There is provided a thermal transfer image-receiving sheet including a substrate sheet, a whiteness-improving layer and a receptive layer provided on top of one another in that order, the whiteness-improving layer including a water-soluble polymer containing a water-soluble fluorescent brightening agent, the receptive layer including a resin soluble in an organic solvent.

9 Claims, No Drawings

THERMAL TRANSFER IMAGE-RECEIVING SHEET

BACKGROUND OF THE INVENTION

1. Field of the Invention

This invention relates to a thermal transfer image-receiving sheet for use in a thermal dye transfer system and more particularly to a thermal transfer image-receiving sheet having improved whiteness in its image-receptive surface by virtue of provision of a specific whiteness-improving layer.

2. Background Art

Various thermal transfer recording systems are known in the art, and one of them is a thermal dye transfer system in which sublimable dyes as colorants are thermally transferred from a thermal transfer sheet comprising a substrate sheet, such as a polyester film, bearing the colorants onto a thermal transfer image-receiving sheet comprising a substrate sheet, such as paper or a plastic film, bearing a dye-receptive layer dyable with a sublimable dye, thereby forming various full-color images on the image-receiving sheet.

In this case, a thermal head mounted on a printer is used as heating means, and dots of three or four colors are transferred onto the receptive layer of a thermal transfer image-receiving sheet by heating for a very short period of time, thereby reproducing a full-color image of an original utilizing the dots of a plurality of colors.

The image thus formed, since dyes are used as the colorant, has excellent sharpness, transparency, halftone reproduction, and gradation, and the quality thereof is comparable to that of images formed by the conventional offset printing or gravure printing and that of full-color photographic images.

A high contrast between an image area and a non-image area and a good appearance are required of the thermal transfer image-receiving sheet used in the above thermal dye transfer system. For meeting this requirement, the whiteness of the image-receiving surface in the thermal transfer image-receiving sheet should be as high as possible.

In order to improve the whiteness of the image-receiving surface, Japanese Patent Laid-Open No. 150389/1990 teaches the use of a substrate having a high whiteness. In this case, however, the substrate is limited, and, further, the whiteness obtained is often still unsatisfactory.

Japanese Patent Laid-Open No. 237693/1986 discloses a thermal transfer image-receiving sheet having improved whiteness provided by incorporating an additive, such as a fluorescent brightening agent or a white filler or pigment, into the receptive layer. In such an image-receiving sheet, however, the additive deteriorates the dyability of the receptive layer, resulting in the formation of a low-density, flat image. Further, some additives pose a problem that the fastness, particularly light fastness, of the image is lowered.

Accordingly, an object of the present invention is to provide a thermal transfer image-receiving sheet free from the above problems of the prior art and having a high whiteness.

SUMMARY OF THE INVENTION

According to the present invention, the above object can be attained by a thermal transfer image-receiving sheet comprising a substrate sheet, a whiteness-improving layer, and a receptive layer provided on top of one another in that order, the whiteness-improving layer comprising a water-soluble polymer containing a water-soluble fluorescent brightening agent, the receptive layer comprising a resin soluble in an organic solvent Since the thermal transfer image-receiving sheet of the present invention has a whiteness-improving layer, containing a specific substance, as an independent layer, unlike the conventional thermal transfer image-receiving sheet with additives, such as a fluorescent brightening agent, incorporated into a receptive layer, an improvement in whiteness of the image-receiving surface can be attained without sacrificing the quality and fastness of the image.

DETAILED DESCRIPTION OF THE INVENTION

Substrate sheet

The substrate sheet functions to support a receptive layer and, since heat is applied at the time of thermal dye transfer, preferably has mechanical strength high enough to cause no trouble when handled in a heated state.

Materials for constituting the substrate sheet is not particularly limited, and examples thereof include various types of papers, such as condenser paper, glassine paper, parchment paper, papers having high size fastness, synthetic papers (polyolefin or polystyrene papers), wood free paper, art paper, coat paper, cast coated paper, wall paper, backing paper, paper impregnated with a synthetic resin or an emulsion, paper impregnated with a synthetic rubber latex, paper with a synthetic resin internally added thereto, paperboard, and cellulose fiber paper, and films of polyesters, polyacrylates, polycarbonates, polyurethane, polyimides, polyetherimides, cellulose derivatives, polyethylene, ethylene/vinyl acetate copolymer, polypropylene, polystyrene, acrylic resin, polyvinyl chloride, polyvinylidene chloride, polyvinyl alcohol, polyvinyl butyral, nylon, polyetheretherketone, polysulfone, polyethersulfone, tetrafluoroethylene/ perfluoroalkyl vinyl ether, polyvinyl fluoride, tetrafluoroethylene/ethylene, tetrafluoroethylene/hexafluoropropylene, polychlorotrifluoroethylene, and polyvinylidene fluoride. It is also possible to use a white opaque film, prepared by adding a white pigment or a filler to the above synthetic resin and forming the mixture into a sheet, and a foamed sheet.

Furthermore, laminates of any combination of the above substrate sheets may also be used. Representative examples of the laminate include a laminate of cellulose fiber paper and synthetic paper and a laminate of cellulose fiber paper and a synthetic paper of a plastic film.

The thickness of the substrate sheet may be any suitable one and usually in the range of from about 10 to 300 μm. If the substrate sheet has poor adhesion to a layer provided thereon, the surface of the substrate sheet is preferably subjected to various types of primer treatments or corona discharge treatments.

Whiteness-improving layers

The whiteness-improving layer provided on the substrate sheet functions to enhance the whiteness of the image-receiving surface of the thermal transfer image- receiving sheet. It may be formed by coating a substrate sheet with a coating solution of a water-soluble polymer and a water-soluble fluorescent brightening agent dissolved or dispersed in a solvent composed mainly of water and then drying the resultant coating. Solvents which can be optionally added to water include alcohols, such as methanol, ethanol, and isopropyl alcohol, and cellosolves, such as methyl cellosolve and ethyl cellosolve.

In the present invention, the water-soluble polymer refers to a polymer which, when added to a solvent containing 50% by weight or more of water, forms a solution with the polymer completely dissolved in water (polymer particle diameter: not more than 0.01 μm), a colloidal dispersion (polymer particle diameter: more than 0.01 μm to not more than 0.1 μm), an emulsion (polymer particle diameter: more than 0.1 μm to not more than 1 μm), or a slurry (polymer particle diameter: more than 1 μm).

Preferably, the water-soluble polymer is sparingly soluble or insoluble in an organic solvent. The term "insoluble" used herein means that the solubility is not more than 1%. Examples of the organic solvent include alcohols such as hexane, cyclohexane, acetone, methyl ethyl ketone, xylene, ethyl acetate, butyl acetate, toluene, methanol, ethanol, and isopropyl alcohol.

Water-soluble polymers include polymers having a hydroxyl group in their structural units (hereinafter referred to as "hydroxyl-containing polymers"), e.g., cellulosic resins (carboxymethyl cellulose being particularly preferred) and polyvinyl alcohol; and polymers not containing a hydroxyl group in their structural units (hereinafter referred to as "hydroxyl-free polymers"), e.g., vinyl resins, such as ethylene/vinyl chloride copolymer, polyvinyl acetate, vinyl chloride/vinyl acetate copolymer, vinyl acetate/(meth) acrylic copolymer, vinyl acetate/Veova copolymer, (meth) acrylic resin, styrene/(meth)acrylic copolymer, and styrene resin, polyamide resins, such as melamine resin, urea resin, and benzoguanamine resin, polyesters, and polyurethanes. Further, polysaccharides, such as starch, proteins (casein being particularly preferred), gelatin, and agar may also be used as the water-soluble polymer. These polymers may be used alone or as a mixture of two or more.

The water-soluble polymer used should be one which has a good compatibility with the color development of the water-soluble fluorescent brightening agent. For this reason, there is a suitable combination of the water-soluble polymer with the water-soluble fluorescent brightening agent. A generally preferred water-soluble polymer is a polyvinyl alcohol resin. The resin should preferably have a degree of saponification from 70 mol % up to 100 mol %.

Further, polyester resins and polyurethane resins are also preferred. Commercially available polyester resins include Polyester WR-900, 901, 905, 930, 950, 960, 961, and W-0005 (manufactured by Nippon Synthetic Chemical Industry Co., Ltd), and Vylonal MD-1100, 1200, 1250, 1330, 1400, and 1930 (manufactured by Toyobo Co., Ltd.), and commercially available polyurethane resins include XW-77-24 (manufactured by Takeda Chemical Industries Ltd.) and WEM-141K (manufactured by Taiseikako Co., Ltd.).

The water-soluble polymers may be used alone or as a mixture of two or more. In this connection, it should be noted that, when the above hydroxyl-containing polymer is used alone as the water-soluble polymer, the adhesion between the whiteness-improving layer and the substrate sheet or between the whiteness-improving layer and the receptive layer are unsatisfactory in some cases. In such a case, since the hydroxyl-free polymers among the above water-soluble polymers have a relatively high adhesion to the substrate sheet and the receptive layer, the use of the hydroxyl-containing polymer in combination with the hydroxyl-free polymer offers a desired adhesion between layers. The weight ratio of the hydroxyl-containing polymer to the hydroxyl-free polymer is preferably 2:8 to 9:1. When polyvinyl alcohol is used as the hydroxyl-containing polymer, the hydroxyl-free polymer is preferably selected from a polyester, a polyurethane, a vinyl chloride resin, a vinyl acetate resin, a styrene resin and a styrene-(meth) acrylate resin.

The water-soluble fluorescent brightening agent may be any known compound having a fluorescent brightening effect, such as stilbene, pyrazoline, oxazole, coumarin, imidazole, distyryl-biphenyl, thiazole, triazole, oxadiazole, thiadiazole, naphthalimide, benzimidazole, benzoxazole, benzothiazole, acetonaphthene, and benzostilbene compounds, provided that they contain a hydrophilic group.

Compounds having a sulfonate group as the hydrophilic group are generally preferred.

Stilbene fluorescent brightening agents are most preferred because they possess a color tone having a fluorescence peak at 400 to 500 nm and are less likely to cause a reduction in intensity of fluorescence due to association and coagulation.

More specifically, water-soluble fluorescent brightening agents usable in the present invention include C. I. FLUORESCENT BRIGHTENER 9, 24, 28, 32, 71, 134, 154, 205, and 252, and commercially available products thereof include Uvitex BAC, NFW, WG, 2B, BHT, MST, and CF, Tinopal SPP, ABP, UP, PT, and SFP (manufactured by Ciba-Geigy Ltd.), BLANKOPHOR FBW, KMH, MBBH, RKH, and HRS (manufactured by BASF Co.), and Mikawhite ATN Conc, KTN Highly Conc, MTN Conc, and ACR Conc (manufactured by Nippon Kayaku Co., Ltd.).

Particularly preferred stilbene fluorescent brightening agents are those represented by the following formula 1.

(1)

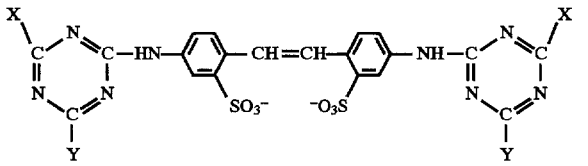

In the chemical formula 1, X and Y may represent a hydrogen atom or an alkyl, substituted alkyl, hydroxy, alkoxy, substituted alkoxy, amino, or substituted amino group. However, substituents represented by the following group of chemical formulae 2 are preferred as X and Y from the viewpoints of various properties such as brightening effect, solubility, and light fastness.

X:

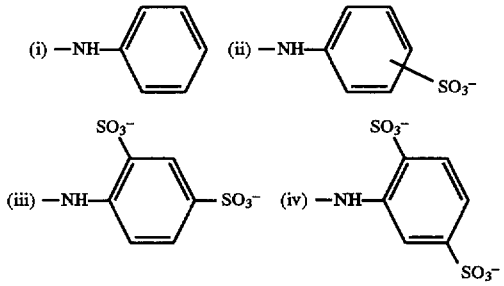

Y:

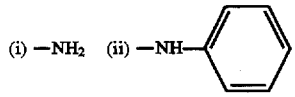

(iv) $-NHCH_3$ (v) $-NHC_2H_5$ (vi) $-OH$
(vii) $-NHCH_2CH_2OH$ (viii) $-N(CH_2CH_2OH)_2$ (ix) $-N(C_2H_5)_2$

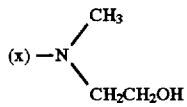

(xi) $-OCH_2CH_2OH$ (xii) $-NHCH_2CH_2OCH_3$ (xiii) $-N[CH_2CH(OH)CH_3]_2$

In the above group of chemical formulae 2, preferred combinations of X and Y are as follows:

(1) X:(ii) Y:(viii)

(2) X:(iv) Y:(ix)

When these stilbene fluorescent brightening agents are used, a water-soluble polymer used in combination there-with should have a hydroxyl group because, if the polymer used has no hydroxyl group, contemplated fluorescent brightening effect cannot be attained.

The use of a water-soluble polymer, as a polymer for constituting the whiteness-improving layer, in combination with a water-soluble fluorescent brightening agent is important to the present invention.

If the polymer for constituting the whiteness-improving layer is insoluble in water but soluble in an organic solvent, the water-soluble fluorescent brightening agent is immiscible with the polymer soluble in an organic solvent, making it impossible to use the water-soluble fluorescent brightening agent. For this reason, if a fluorescent brightening agent soluble in an organic solvent is used in combination with the polymer soluble in an organic solvent to form a while opaque layer and a receptive layer formed of a resin soluble in an organic solvent is provided thereon, the brightening agent migrates to the receptive layer, adversely affecting the image. The use of a water-soluble resin as a resin for constituting the receptive layer is necessary in order to avoid the migration of the fluorescent brightening agent soluble in an organic solvent to the receptive layer. The receptive layer formed of the water-soluble resin, however, has deteriorated dyability and dye holding capability and, hence, is unsatisfactory in image density and storage stability.

According to the present invention, titanium oxide can be added to the whiteness-improving layer for the purpose of hiding glaring and irregularities of the substrate sheet.

The titanium oxide can be classified into two types, rutile titanium oxide and anatase titanium oxide. When the whiteness and the effect of the fluorescent brightening agent is taken into consideration, preference is given to anatase titanium oxide, which exhibits UV absorption on a shorter wavelength side, over rutile titanium oxide.

When it is difficult to disperse the titanium oxide in the aqueous polymer solution, titanium oxide having a surface subjected to a treatment for rendering the surface hydrophilic may be used, or alternatively titanium oxide may be successfully dispersed by adding a known dispersant such as a surfactant or ethylene glycol.

Further, in order to facilitate the dispersion, it is possible to use a method wherein a titanium oxide paste is previously prepared and then dispersed in the polymer solution. The titanium oxide paste may be prepared by adding a known dispersant, such as a surf actant or ethylene glycol, to a titanium oxide powder and dispersing the mixture in a single solvent of water, an alcohol, a cellosolve or the like or in a mixed solvent of any combination of the above solvents in suitable proportions. Commercially available products of the titanium oxide paste include Dispa Color White AEX, Dispa Color White High Conc EX, Color Paste White N, and Color Paste White High Conc RN (manufactured by Tohpe Corporation).

The titanium oxide may be used in the whiteness-improving layer generally in an amount of 30 to 300 parts by weight, preferably 100 to 300 parts by weight, based on 100 parts by weight of the water-soluble polymer.

The whiteness-improving layer of the present invention may be formed by coating a coating solution (or dispersion) of the water-soluble polymer, the water-soluble fluorescent brightening agent and optionally titanium oxide dissolved or dispersed in water onto a substrate sheet, for example, by gravure printing, screen printing, reverse rolling coating using a gravure plate or the like and drying the resultant coating.

The whiteness-improving layer thus formed can serve to improve the whiteness of the image-receiving surface of the thermal transfer-image receiving sheet, offering a high contrast between an image area and a non-image area and a good appearance.

Receptive layer

The receptive layer provided on the whiteness-improving layer functions to receive a dye being transferred from a thermal transfer sheet and to hold the resultant image thereon.

The receptive layer of the present application is formed using a solution of an organic solvent-soluble resin dissolved in an organic solvent. The formation of the receptive layer using a solution or a dispersion of a water-soluble resin causes the water-soluble fluorescent brightening agent contained in the whiteness-improving layer to migrate into the receptive layer. Further, since a water-soluble resin generally has poor miscibility with dyes, there is a fear that the dyes separate out after the formation of an image.

Resins usable for forming the receptive layer include polyolefin resins such as polypropylene; halogenated polymers such as polyvinyl chloride and polyvinylidene chloride; vinyl resins such as polyvinyl acetate, ethylene/vinyl acetate copolymer, vinyl chloride/vinyl acetate copolymer, and polyacrylic esters; acetal resins such as polyvinyl formal, polyvinyl butyral, and polyvinyl acetal; saturated and unsaturated various polyester resins; polycarbonate resins; cellulosic resins such as cellulose acetate; styrene resins such as polystyrene, (meth)acrylate/styrene copolymer, and acrylonitrile/styrene copolymer; and polyamide resins such as urea resin, melamine resin, and benzoguanamine resin. These resins may be used singly or as a blend of two or more.

When the water-soluble polymer of the whiteness-improving layer has active hydrogen, such as a hydroxyl or carboxyl group, the incorporation of a curing agent reactive with the active hydrogen in the receptive layer results in improved adhesion between the whiteness-improving layer and the receptive layer.

The conventional isocyanate compounds, amino compounds, and organometal compounds are preferred as the curing agent. In order to enhance the curing reaction rate, the curing agent may be used in combination with a suitable catalyst.

The above resin constituting a receptive layer, when heat is applied upon thermal transfer of a dye, can fuse to a binder resin used for holding dyes in a thermal transfer sheet. In order to prevent this and provide good releasability to the receptive layer, it is preferred to incorporate in the receptive layer various release agents, such as phosphoric esters, surfactants, fluorine compounds, fluororesins, silicone compounds, silicone oil, or silicone resin. The addition of a modified silicone oil followed by curing is particularly preferred.

The amount of the release agent added varies depending upon the kind of the release agent. In general, however, the amount of the release agent on a dry basis is about 1 to 20 parts by weight based on 100 parts by weight of the resin on a solid basis.

When a modified silicone oil having a group reactive with the above curing agent, among the modified silicone oils, is added, the equivalent ratio of the modified silicone oil to the reactive group of the curing agent is preferably in the range of from 1:1 to 1:10.

Further, it is also possible to laminate, as a release layer, a layer of the release agent or a layer of a mixture of a binder resin with the release agent on the receptive layer.

A pigment or a filler, such as titanium oxide, zinc oxide, or finely divided silica, may be added to the receptive layer for the purpose of enhancing the whiteness or providing matte appearance.

The receptive layer may be formed by dissolving or dispersing a mixture of the resin with the optional additive (s) in a suitable organic solvent, coating the coating solution (dispersion) onto the whiteness-improving layer by, for example, gravure printing, screen printing or reverse roll coating, and drying the resultant coating.

Although the thickness of the receptive layer thus formed may be any desired value, it is generally in the range of from 1 to 50 μm.

Protective layer

A protective layer may be provided on the receptive layer in order to protect the image formed on the receptive layer.

The protective layer may comprise a 0.5 to 50 μm-thick resin film formed by using a protective layer transfer sheet comprising a polyester film bearing a release layer, a transparent resin layer, an adhesive layer, and optionally a UV barrier.

The release layer may be formed of a resin such as polyvinyl alcohol, the transparent resin layer may be formed of a transparent resin such as an acrylic resin, and the adhesive layer may be formed of a vinyl chloride/vinyl acetate copolymer resin, a styrene/acrylate copolymer resin or the like.

In order to increase the light fastness, a cerium-based UV absorber may be incorporated into the transparent resin layer or the adhesive layer. Alternatively, a separate layer formed of the UV absorber incorporated into an acrylic resin may be provided between the transparent resin layer and the adhesive layer.

Back side layer

A back side layer may be provided on the back side of the thermal transfer image-receiving sheet for purposes of improvement in mechanical carriability of the sheet, prevention of curling of the sheet, or attainment of antistatic effect or for other purposes.

When improved carriability of the sheet is desired, it is preferred to add a suitable amount of an organic or inorganic filler to a binder resin or alternatively to use a highly slippery resin such as a polyolefin resin or a cellulose resin.

On the other hand, when it is desired to impart an antistatic property to the sheet, a layer formed of a conductive layer, such as an acrylic resin, or a conductive filler with an antistatic agent, such as a fatty acid ester, a sulfuric ester, a phosphoric ester, an amide, a quaternary ammonium salt, a betaine, an amino acid, or an ethylene oxide adduct being incorporated therein may be formed on the substrate or between the back side layer for improving the carriability and the substrate.

The amount of the antistatic agent used may vary depending upon the type of the layer, to which the antistatic layer is added, and the type of the antistatic agent. It, however, is generally 0.01 to 3.0 g/m$^2$, and in all cases, the surface resistivity of the thermal transfer image-receiving sheet should preferably be not more than $10^{13}$ Ω/cm$^2$. When the surface resistivity exceeds $10^{13}$ Ω/cm$^2$, thermal transfer image-receiving sheets are likely to adhere to each other due to static electricity, causing sheet-feed troubles.

Thermal transfer sheets to be used for thermal transfer printing using the above thermal transfer image-receiving sheet include a dye sublimation thermal transfer sheet used in a dye sublimation transfer recording system and, in addition, a hot-melt thermal transfer sheet, comprising a substrate bearing, coated thereon, a hot melt ink layer of a colorant, such as a pigment, held by a hot- melt binder, wherein upon heating the ink layer, in its entirety, is transferred to an object.

The following examples further illustrate the present invention but are not intended to limit it. In the following examples, all "%" or "parts" are by weight unless otherwise specified.

The following coating solutions were prepared.

| Coating solutions for whiteness-improving layer | |
|---|---|
| 1) Cellulose resin (Cellogen F-7A, manufactured by Dai-Ichi Kogyo Seiyaku Co., Ltd.) | 10 parts |
| Stilbene fluorescent brightening agent (Uvitex CF, manufactured by Ciba-Geigy Co.) | 2 parts |
| Water | 90 parts |
| 2) Polyvinyl alcohol (Gosenol NM-11, manufactured by Nippon Synthetic Chemical Industry Co., Ltd.) | 10 parts |
| Distyryl biphenyl fluorescent brightening agent (Uvitex NFW, manufactured by Ciba-Geigy Co.) | 2 parts |
| Water/ethanol = 1/1 | 90 parts |
| 3) Polyvinyl alcohol (Gosenol NM-11, manufactured by Nippon Synthetic Chemical Industry Co., Ltd.) | 10 parts |
| Stilbene fluorescent brightening agent (BLACKOPHOR KMH, manufactured by BASF Co.) | 4 parts |
| Titanium oxide (TCR-30 rutile type, manufactured by Tochem Products Corporation) | 30 parts |
| Water/ethanol = 9/1 | 90 parts |
| 4) Polyvinyl alcohol (Gosenol KL-05, manufactured by Nippon Synthetic Chemical Industry Co., Ltd.) | 10 parts |
| Stilbene fluorescent brightening agent (TINOPAL SFP, manufactured by Ciba-Geigy Co.) | 2 parts |
| Titanium oxide (TCA888 anatase type, manufactured by Tochem Products Corporation) | 5 parts |
| Water/IPA = 9/1 | 110 parts |
| 5) Polyvinyl alcohol (Gosenol KL-05, manufactured by Nippon Synthetic Chemical Industry Co., Ltd.) | 10 parts |
| Polyester resin (Vylonal MD-1200, manufactured by Toyobo Co., Ltd) | 10 parts |
| Stilbene fluorescent brightening agent (TINOPAL SFP, manufactured by Ciba-Geigy Co.) | 4 parts |
| Water/methyl cellosolve = 8/2 | 110 parts |
| 6) Polyvinyl alcohol (Gosenol KL-05, manufactured by Nippon Synthetic Chemical Industry Co., Ltd.) | 10 parts |
| Urethane resin (Elastron C-9, manufactured by Dai-Ichi Kohyo Seiyaku Co., Ltd.) | 10 parts |
| Stilbene fluorescent brightening agent (TINOPAL PT, manufactured by Ciba-Geigy Co.) | 6 parts |
| Titanium oxide (ASD anatase type, manufactured by Tochem Products Corporation) | 40 parts |
| Water/ethyl cellosolve = 8/2 | 130 parts |
| 7) Polyvinyl alcohol (Gosenol KL-05, manufactured by Nippon Synthetic Chemical Industry Co., Ltd.) | 10 parts |
| Polyvinyl chloride resin (B-300, manufactured by Denki Kagaku Kogyo k.k.) | 10 parts |
| Pyrazoline fluorescent brightening agent (BLACKOPHOR FBW, manufactured by BASF Co.) | 2 parts |
| water/butyl cellosolve = 8/2 | 130 parts |
| 8) Polyvinyl alcohol (Gosenol KL-05, manufactured by Nippon Synthetic Chemical Industry Co., Ltd.) | 10 parts |
| Polyvinyl acetate resin (Polysol AX-428, manufactured by Showa High Polymer Co., Ltd.) | 10 parts |
| Benzimidazole fluorescent brightening agent (Uvitex BAC, manufactured by Ciba-Geigy Co.) | 4 parts |
| Titanium oxide (A-150 anatase type, manufactured by Sakai Chemical Co. Ltd.) | 20 parts |

-continued

| Coating solutions for whiteness-improving layer | |
|---|---|
| Water | 100 parts |
| 9) Polyvinyl alcohol (Gosenol KL-05, manufactured by Nippon Synthetic Chemical Industry Co., Ltd.) | 10 parts |
| Styrene resin (Polysol C-10, manufactured by Showa High Polymer Co., Ltd.) | 10 parts |
| Pyrazoline fluorescent brightening agent (Uvitex WG, manufactured by Ciba-Geigy Co.) | 2 parts |
| Water | 100 parts |
| 10) Polyvinyl alcohol (Gosenol KL-05, manufactured by Nippon Synthetic Chemical Industry Co., Ltd.) | 10 parts |
| Styrene/acrylic resin (Polysol AT-2011, manufactured by Showa High Polymer Co., Ltd.) | 10 parts |
| Stilbene fluorescent brightening agent (TINOPAL PT, manufactured by Ciba-Geigy Co.) | 2 parts |
| Titanium oxide (CR-60 anatase type, manufactured by Ishihara Sangyo Kaisha Ltd.) | 2 parts |
| Water | 100 parts |
| 11) Chlorinated propylene resin (B-13, manufactured by Toyo Kasei Kogyo Co., Ltd.) | 10 parts |
| Benzoxazole fluorescent brightening agent (Uvitex OB, manufactured by Ciba-Geigy Co.) | 1 part |
| Titanium oxide (TCA888 anatase type, manufactured by Tohchem Products Corporation) | 30 parts |
| Methyl ethyl ketone/toluene = 1/1 | 90 parts |
| 12) Polyester resin (Polyester WR-901, manufactured by Nippon Synthetic Chemical Industry Co., Ltd.) | 30 parts |
| Benzimidazole fluorescent brightening agent (Uvitex BAC, manufactured by Ciba-Geigy Co.) | 1.2 parts |
| Titanium oxide (Dispa Color White AEX (anatase type), manufactured by Tohpe Corporation) | 16 parts |
| Water | 90 parts |
| 13) Polyester resin (Polyester WR-905, manufactured by Nippon Synthetic Chemical Industry Co., Ltd.) | 10 parts |
| Benzimidazole fluorescent brightening agent (Uvitex BAC, manufactured by Ciba-Geigy Co.) | 1.5 parts |
| Titanium oxide (TCA888 (anatase type), manufactured by Tohchem Products Corporation) | 20 parts |
| Water/isopropyl alcohol = 1/1 | 100 parts |
| 14) Polyester resin (Polyester WR-905, manufactured by Nippon Synthetic Chemical Industry Co., Ltd.) | 30 parts |
| Benzimidazole fluorescent brightening agent (Uvitex BAC, manufactured by Ciba-Geigy Co.) | 1.6 parts |
| Titanium oxide (Color Paste White (anatase type), manufactured by Tohpe Corporation) | 50 parts |
| Water/isopropyl alcohol = 9/1 | 130 parts |
| 15) Polyester resin (Vylonal MD-1400, manufactured by Toyobo Co., Ltd.) | 20 parts |
| Benzimidazole fluorescent brightening agent (Uvitex BAC, manufactured by Ciba-Geigy Co.) | 1.2 parts |
| Titanium oxide (Dispa Color White AEX (anatase type), manufactured by Tohpe Corporation) | 50 parts |
| Water/isopropyl alcohol = 9/1 | 130 parts |
| 16) Polyurethane resin (XW-77-24, manufactured by Takeda Chemical Industries Ltd.) | 10 parts |
| Distyryl biphenyl fluorescent brightening agent (Uvitex NFW, manufactured by Ciba-Geigy Co.) | 2 parts |
| Titanium oxide (TCA888 (anatase type), manufactured by Tohchem Products Corporation) | 10 parts |
| Water/Isopropyl alcohol = 1/1 | 110 parts |
| 17) Polyurethane resin (WEN-141K, manufactured by Taiseikako Co., Ltd.) | 10 parts |
| Distyryl biphenyl fluorescent brightening agent (Uvitex NFW, manufactured by Ciba-Geigy Co.) | 5 parts |
| Titanium oxide (TCA888 (anatase type), manufactured by Tohchem Products Corporation) | 10 parts |
| Water/Isopropyl alcohol = 1/1 | 110 parts |

| Coating solutions for receptive layer | |
|---|---|
| 1) Vinyl chloride/vinyl acetate copolymer resin (#1000C, manufactured by Denki Kagaku Kogyo k.k.) | 10 parts |
| Addition polymerization type silicone (KNS202A, manufactured by The Shin-Etsu Chemical Co., Ltd.) | 1 part |
| Catalyst (CAT-PL-8, manufactured by The Shin-Etsu Chemical Co., Ltd.) | 0.6 part |
| Methyl ethyl ketone/toluene = 1/1 | 40 parts |
| 2) Polyester resin (Vylon 200, manufactured by Toyobo Co., Ltd.) | 10 parts |
| Hydroxyl-modified silicone (X-22-160AS, manufactured by The Shin-Etsu Chemical Co., Ltd.) | 0.3 part |
| Isocyanate compounds (Takenate XA-14, manufactured by Takeda Chemical Industries) | 0.6 parts |
| Dibutyl tin laurate | 0.02 part |
| Methyl ethyl ketone/toluene = 1/1 | 40 parts |
| 3) Vinyl chloride/vinyl acetate copolymer resin (#1000C, manufactured by Denki Kagaku Kogyo k.k.) | 7 parts |
| Polyester resin (Vylon 600, manufactured by Toyobo Co., Ltd.) | 3 parts |
| Chelate compounds (Orgatix TC-100, manufactured by Matsumoto Trading Co., Ltd.) | 1 part |
| Methyl ethyl ketone/toluene = 1/1 | 40 parts |
| 4) Vinyl chloride/vinyl acetate copolymer resin (#1000C, manufactured by Denki Kagaku Kogyo k.k.) | 10 parts |
| Amino-modified silicone (KF-393, manufactured by The Shin-Etsu Chemical Co., Ltd.) | 0.3 part |
| Epoxy-modified silicone (X-22-343, manufactured by The Shin-Etsu Chemical Co., Ltd.) | 0.6 part |
| Methyl ethyl ketone/toluene = 1/1 | 40 parts |
| 5) Vinyl chloride/vinyl acetate copolymer resin (#1000MT2, manufactured by Denki Kagaku Kogyo k.k.) | 7 parts |
| Acrylonitrile/styrene copolymer resin (Cevian N010, manufactured by Daicel Chemical Industries, Ltd.) | 3 parts |
| Epoxy-modified silicone (X-22-343, manufactured by The Shin-Etsu Chemical | 0.6 part |
| Addition polymerization type silicone (KNS202A:S, manufactured by The Shin-Etsu Chemical Co., Ltd.) | 0.3 part |
| Catalyst (CAT-PL-8, manufactured by The Shin-Etsu Chemical Co., Ltd.) | 0.3 part |
| Methyl ethyl ketone/toluene = 1/1 | |

| Coating solution for release layer | |
|---|---|
| Amino-modified silicone (KF-393, manufactured by The Shin-Etsu Chemical Co., Ltd.) | 1 part |
| Epoxy-modified silicone (X-22-343, manufactured by The Shin-Etsu Chemical Co., Ltd.) | 1 part |
| Methyl ethyl ketone/toluene = 1/1 | 98 parts |

Preparation of thermal transfer image-receiving sheet

EXAMPLE 1

A 150 μm-thick synthetic paper (YUPO FPG #150, manufactured by Oji-Yuka Synthetic Paper Co., Ltd.) was provided as a substrate sheet. The coating solution 1), for a whiteness-improving layer, having the above composition was coated by wire bar coating on one side of the substrate sheet at a coverage of 3.0 g/m$^2$ (dry basis), and the resultant coating was dried at 130° C. for 3 minutes. The coating solution 1) for a receptive layer was coated on the whiteness-improving layer by wire bar coating at a coverage of 5.0 g/m$^2$ (dry basis), and the resultant coating was dried at 130° C. for 3 min, thereby preparing a thermal transfer image-receiving sheet.

EXAMPLE 2

A thermal transfer image-receiving sheet was prepared in the same manner as in Example 1, except that the coating solution 2) for a whiteness-improving layer and the coating solution 2) for a receptive layer were used instead of the coating solutions of Example 1.

EXAMPLE 3

The procedure of Example 1 was repeated, except that the coating solution 3) for a whiteness-improving layer and the coating solution 3) for a receptive layer were used instead of the coating solutions of Example 1. The above coating solution for a release layer was coated by means of a wire bar No. 6 on the receptive layer, and the coating was dried at 130° C. for 3 minutes to prepare a thermal transfer image-receiving sheet.

EXAMPLE 4

A thermal transfer image-receiving sheet was prepared in the same manner as in Example 1, except that the coating solution 4) for a whiteness-improving layer and the coating solution 2) for a receptive layer were used instead of the coating solutions of Example 1.

EXAMPLE 5

The procedure of Example 1 was repeated, except that the coating solution 5) for a whiteness-improving layer and the coating solution 3) for a receptive layer were used instead of the coating solutions of Example 1. The above coating solution for a release layer was coated by means of a wire bar No. 6 on the receptive layer, and the coating was dried at 130° C. for 3 minutes to prepare a thermal transfer image-receiving sheet.

EXAMPLE 6

A thermal transfer image-receiving sheet was prepared in the same manner as in Example 1, except that the coating solution 6) for a whiteness-improving layer and the coating solution 1) for a receptive layer were used instead of the coating solutions of Example 1.

EXAMPLE 7

A thermal transfer image-receiving sheet was prepared in the same manner as in Example 1, except that the coating solution 7) for a whiteness-improving layer and the coating solution 2) for a receptive layer were used instead of the coating solutions of Example 1.

EXAMPLE 8

The procedure of Example 1 was repeated, except that the coating solution 8) for a whiteness-improving layer and the coating solution 3) for a receptive layer were used instead of the coating solutions of Example 1. The above coating solution for a release layer was coated by means of a wire bar No. 6 on the receptive layer, and the coating was dried at 130° C. for 3 minutes to prepare a thermal transfer image-receiving sheet.

EXAMPLE 9

A thermal transfer image-receiving sheet was prepared in the same manner as in Example 1, except that the coating solution 9) for a whiteness-improving layer and the coating solution 1) for a receptive layer were used instead of the coating solutions of Example 1.

EXAMPLE 10

A thermal transfer image-receiving sheet was prepared in the same manner as in Example 1, except that the coating solution 10) for a whiteness-improving layer and the coating solution 2) for a receptive layer were used instead of the coating solutions of Example 1.

EXAMPLE 11

A thermal transfer image-receiving sheet was prepared in the same manner as in Example 1, except that the coating solution 12) for a whiteness-improving layer and the coating solution 4) for a receptive layer were used instead of the coating solutions of Example 1.

EXAMPLE 12

A thermal transfer image-receiving sheet was prepared in the same manner as in Example 1, except that the coating solution 13) for a whiteness-improving layer and the coating solution 4) for a receptive layer were used instead of the coating solutions of Example 1.

EXAMPLE 13

A thermal transfer image-receiving sheet was prepared in the same manner as in Example 1, except that the coating solution 14) for a whiteness-improving layer and the coating solution 4) for a receptive layer were used instead of the coating solutions of Example 1.

EXAMPLE 14

A thermal transfer image-receiving sheet was prepared in the same manner as in Example 1, except that the coating solution 15) for a whiteness-improving layer and the coating solution 4) for a receptive layer were used instead of the coating solutions of Example 1.

EXAMPLE 15

A thermal transfer image-receiving sheet was prepared in the same manner as in Example 1, except that the coating solution 16) for a whiteness-improving layer and the coating solution 4) for a receptive layer were used instead of the coating solutions of Example 1.

EXAMPLE 16

A thermal transfer image-receiving sheet was prepared in the same manner as in Example 1, except that the coating solution 17) for a whiteness-improving layer and the coating solution 4) for a receptive layer were used instead of the coating solutions of Example 1.

EXAMPLE 17

A thermal transfer image-receiving sheet was prepared in the same manner as in Example 1, except that the coating solution 13) for a whiteness-improving layer and the coating solution 5) for a receptive layer were used instead of the coating solutions of Example 1.

COMPARATIVE EXAMPLE 1

A thermal transfer image-receiving sheet was prepared in the same manner as in Example 1, except that the coating solution 11) for a whiteness-improving layer and the coating solution 1) for a receptive layer were used instead of the coating solutions of Example 1.

COMPARATIVE EXAMPLE 2

A thermal transfer image-receiving sheet was prepared in the same manner as in Example 1, except that the coating solution 11) for a whiteness-improving layer and the coating solution 2) for a receptive layer were used instead of the coating solutions of Example 1.

COMPARATIVE EXAMPLE 3

The procedure of Example 1 was repeated, except that the coating solution 11) for a whiteness-improving layer and the coating solution 3) for a receptive layer were used instead of the coating solutions of Example 1. The above coating solution for a release layer was coated by means of a wire bar No. 6 on the receptive layer, and the coating was dried at 130° C. for 3 minutes to prepare a thermal transfer image-receiving sheet.

Preparation of thermal transfer sheet

A coating solution, for a dye layer, having the following composition was prepared and coated at a coverage of 1.0 g/m$^2$ (dry basis) on one side of a 6 μm-thick polyethylene terephthalate film, the opposite side of which has been subjected to a treatment for rendering the side heat-resistant, and the resultant coating was dried to prepare a thermal transfer sheet.

| Coating solution for dye layer | |
|---|---|
| Cyan dye (chemical formula 3) | 4 parts |
| Polyvinyl butyral resin (S-lec BX-1, manufactured by Sekisui Chemical Co., Ltd.) | 3 parts |
| Methyl ethyl ketone/toluene = 1/1 | 53 parts |

Cyan dye:

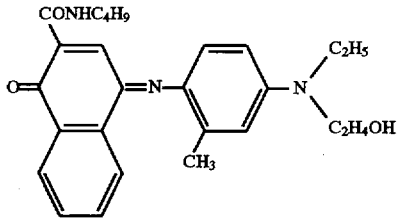

Chemical Formula 3

Each of the thermal transfer image-receiving sheets prepared in the examples and the comparative examples and the thermal transfer sheet prepared above were put on top of the other so that the dye-receiving surface faced the dye layer, and heating was carried out from the back side of the thermal transfer sheet by means of a thermal head.

More specifically, recording using a thermal head was carried out under heating conditions of an applied voltage of 14.5 V, a step pattern with the applied pulse width being successively reduced from 6.4 msec/line for each 0.4 msec, and 6 lines/mm (10 msec/line) in the subscanning direction, thereby forming cyan images. Thereafter, the quality and various types of durability of the images were evaluated. The results are given in the following Table 1.

Various properties given in Table 1 were evaluated by the following methods.

(1) Whiteness

The whiteness was measured with "OPIRON BRIGHTNESS (manufactured by Toyo Seiki Seisaku Sho, Ltd.)" according to JIS P8123.

Evaluation criteria:

○ . . . Not less than 80%

X . . . Less than 80%

(2) b* value (according to JIS Z8730 "Color Difference Denotation Method" 3-(1) L*, a*, b* color specification system)

The b* value was measured with a color/color difference meter CR-221 (MINOLTA).

Evaluation criteria:

○ . . . Not more than −1.00

X . . . More than −1.00

(3) Light fastness

The initial density at a reflection density of about 1.00 was measured with a Macbeth reflection densitometer RD918 (manufactured by Sakata INX Corp.), and the density after light irradiation using a light fastness tester was measured. The percentage retention of density was calculated by the following equation.

$$\text{Retention (\%)} = (\text{density after irradiation}/\text{initial density}) \times 100$$

Light fastness tester: FAD-OMETER Ci35 (ATLAS ELECTRIC DEVICES Co., Toyo Seiki Seisaku Sho, Ltd.)

Light irradiation dose: 200 kJ/m$^2$

Evaluation criteria:

◎ . . . Retention of more than 80%

○. . . Retention of 70 to 80%

Δ . . . Retention of 60 to 70%

X . . . Retention of less than 60%

(4) Adhesion

A Scotch mending tape (Sumitomo 3M Ltd.) was lightly applied to the image-receiving surface of the thermal transfer image-receiving sheet and then gently peeled from the image-receiving surface to evaluate the adhesion between layers of the sheet.

Evaluation criteria:

○ . . . Tape clearly peeled from the image-receiving surface

X . . . Separation occurred between the substrate and the whiteness-improving layer or between the white opaque layer and the receptive layer (5) Max. OD (maximum optical density)

The reflection density in each step was measured with a Macbeth reflection densitometer RD918 (Sakata INX Corp.), and the largest reflection density was regarded as Max. OD.

Evaluation criteria:

○ . . . Not less than 1.80

X . . . Less than 1.80

TABLE 1

| | White-ness | b* value | Light fast-ness | Ad-hesion | Max. OD |
|---|---|---|---|---|---|
| Example 1 | ○ | ○ | ○ | ○ | ○ |
| Example 2 | ○ | ○ | ◎ | ○ | ○ |
| Example 3 | ○ | ○ | ○ | ○ | ○ |
| Example 4 | ○ | ○ | ◎ | ○ | ○ |

TABLE 1-continued

| | White-ness | b* value | Light fast-ness | Ad-hesion | Max. OD |
|---|---|---|---|---|---|
| Example 5 | ○ | ○ | ○ | ○ | ○ |
| Example 6 | ○ | ○ | ○ | ○ | ○ |
| Example 7 | ○ | ○ | ◎ | ○ | ○ |
| Example 8 | ○ | ○ | ○ | ○ | ○ |
| Example 9 | ○ | ○ | ○ | ○ | ○ |
| Example 10 | ○ | ○ | ◎ | ○ | ○ |
| Example 11 | ○ | ○ | ◎ | ○ | ○ |
| Example 12 | ○ | ○ | ◎ | ○ | ○ |
| Example 13 | ○ | ○ | ◎ | ○ | ○ |
| Example 14 | ○ | ○ | ◎ | ○ | ○ |
| Example 15 | ○ | ○ | ◎ | ○ | ○ |
| Example 16 | ○ | ○ | ◎ | ○ | ○ |
| Example 17 | ○ | ○ | ◎ | ○ | ○ |
| Comparative Example 1 | ○ | ○ | X | ○ | ○ |
| Comparative Example 2 | ○ | ○ | Δ | ○ | ○ |
| Comparative Example 3 | ○ | ○ | X | ○ | ○ |

What is claimed is:

1. A thermal transfer image-receiving sheet comprising:

a substrate sheet;

a whiteness-improving layer formed on said substrate sheet and comprising a water-soluble polymer containing a water-soluble fluorescent brightening agent; and a receptive layer formed on said whiteness-improving layer and comprising a resin soluble in an organic solvent.

2. The thermal transfer image-receiving sheet according to claim 1, wherein the fluorescent brightening agent comprises a stilbene fluorescent brightening agent.

3. The thermal transfer image-receiving sheet according to claim 1, wherein the fluorescent brightening agent has a sulfonic acid group.

4. The thermal transfer image-receiving sheet according to claim 1, wherein the water-soluble polymer has a hydroxyl group.

5. The thermal transfer image-receiving sheet according to claim 4, wherein the water-soluble polymer comprises polyvinyl alcohol.

6. The thermal transfer image-receiving sheet according to claim 1, wherein said water-soluble polymer comprises a mixture of polyvinyl alcohol and a water-soluble polymer other than polyvinyl alcohol.

7. The thermal transfer image-receiving sheet according to claim 6, wherein the water-soluble polymer other than polyvinyl alcohol is selected from a polyester, a polyurethane, a vinyl chloride resin, a vinyl acetate resin, a styrene resin and a styrene/(meth)acrylate resin.

8. The thermal transfer image-receiving sheet according to claim 1, wherein the whiteness-improving layer further comprises titanium oxide.

9. The thermal transfer image-receiving sheet according to claim 8, wherein the titanium oxide is in the form of anatase.

* * * * *